United States Patent [19]

Drake et al.

[11] 3,995,567

[45] Dec. 7, 1976

[54] WASTE FUEL INCINERATOR AND POLLUTANT REMOVAL SYSTEM

[75] Inventors: Dale E. Drake, Concrete; Jochum G. Kalt, Mount Vernon, both of Wash.

[73] Assignee: Enertherm, Inc., Mount Vernon, Wash.

[22] Filed: June 20, 1975

[21] Appl. No.: 588,669

[52] U.S. Cl. ..... 110/7 R; 110/8 C; 110/119

[51] Int. Cl.[2] ..... F23G 7/00

[58] Field of Search ..... 110/7 R, 8 R, 8 C, 18 R, 110/18 C, 119

[56] References Cited

UNITED STATES PATENTS

| | | | |
|---|---|---|---|
| 3,460,489 | 8/1969 | Ehrenzeller et al. | 110/18 |
| 3,487,620 | 1/1970 | Klein et al. | 110/119 |
| 3,536,018 | 10/1970 | Phelps | 110/18 |
| 3,601,069 | 8/1971 | Mancuso | 110/119 |
| 3,651,771 | 3/1972 | Eberle | 110/8 |
| 3,745,939 | 7/1973 | Allbritton | 110/119 |
| 3,769,921 | 11/1973 | McMullen | 110/8 |
| 3,812,793 | 5/1974 | Solomon | 110/119 |
| 3,841,241 | 10/1974 | Dewey et al. | 110/8 |

*Primary Examiner*—Kenneth W. Sprague
*Attorney, Agent, or Firm*—Warren J. Krauss

[57] ABSTRACT

A system for the combustion and utilization of waste products for the production of heat energy in a clean pollutant-free medium. The system includes forced air swirling-type incinerator having means for controllably admitting fuel in the form of waste products and having exhaust stack means for removal of combustion medium in the form of heated gases therefrom. The system further includes a particle removal and retention arrangement for treating the heated combustion medium from the incinerator and for removing both gross and miniscule particulate therefrom before transmitting said medium to a point of beneficial utilization. The particle retention arrangement includes revolving screen means and washing means therefor as well as filter means disposed to intercept the heated medium passing through the revolving screen means.

18 Claims, 4 Drawing Figures

WASTE FUEL INCINERATOR AND POLLUTANT REMOVAL SYSTEM

CROSS REFERENCE TO RELATED APPLICATIONS

The present application relates to U.S. patent application, Ser. No. 543,491, entitled: THERMAL RECOVERY SYSTEM, filed on Jan. 23, 1975, by Drake et al., of common assignment herewith.

BACKGROUND OF THE INVENTION

This invention relates to an incinerating system which advantageously utilizes normally wasted materials as fuel to produce heat energy while reducing industrial air pollution. In particular, the invention relates to an incinerator equipped with particle retention and filtration means which combusts waste products fuel in a lumber mill and which cleans the combustion medium before passage therof to a drying kiln for utilization in drying cut lumber.

Increased public awareness of the need to protect the environment by drastically reducing industrial air pollution and by conserving the earth's natural resources as well as specific legislation such as the Air Pollution Control Agency regulations have made it incumbent upon industry to develop new methods and means for operating within reasonable environmental guidelines.

In industrial operations wherein waste product production is voluminous, such as in the lumber industry, the disposal problem is particularly vexatious. Due to the impracticability of ocean dumping and in view of the many difficulties associated with sanitary land fill operations, incineration of such waste materials has traditionally been industry's solution to the problem. However, many present day incinerating operations do not meet environmental standards inasmuch as they often involve direct exhaustion of high temperature pollutant-laden products of combustion into the atmosphere. Such systems are also generally wasteful of the energy contained in such combustion products.

Many prior art attempts have been made to address these and other related problems. The aforementioned U.S. patent application, Ser. No. 543,491, filed by Drake et al. discloses a system which, because of the manner in which the waste materials are consumed, produces a substantially clean exhaust medium which may be mixed with proportioned quantities of ambient air for temperature control and transmitted directly to a point of use so that most of the energy in the medium is utilized efficiently. However, where extremely clean exhaust medium is required, an efficient system for processing the exhaust medium and for removing therefrom both gross and miniscule particulate is required. It is to the fulfillment of this requirement that the instant invention is directed.

SUMMARY AND OBJECTS OF THE INVENTION

The instant invention provides an incinerating system which utilizes available waste products such as lumber shavings, bark, etc. as a fuel and which processes the products of combustion thereof so as to substantially entirely remove gross and miniscule particulate therefrom to create a clean heated medium which may be transmitted directly to a point of efficient utilization. The incinerator includes a plurality of fuel feeding means and forced air blowers which produce an accelerated Coriolis force and cause a cyclonic effect which tends to initially remove, by consumption, a major portion of the heavy particulate from the heated medium. The incinerator or burner is connected by means of insulated stacking or conduit means to a particle removal and retention arrangement which includes a revolving steel screen which engages and removes gross particulate from the medium and a bank of filters which remove miniscule particulate from the medium. The particle retention arrangement includes a washing system for removal of entrapped particulate from the steel screen. An automated control system controls and coordinates all functions in the system in accordance with given heat demand criteria and other parameters.

The primary object of the present invention is to provide means for controlling industrial air pollution and for recovering and directly utilizing heat energy from waste product incineration.

Another object of the present invention is to provide a waste products incinerating system particularly applicable to lumber mill operations where there is a need to incinerate large quantities of waste wood products and a corresponding need for hot, clean gaseous medium for lumber drying and treating processes.

A further object of the present invention is to provide a simple, relatively inexpensive, incinerating system and filtering means therefor having few moving parts and being readily adaptable to a plurality of applications with minor structural modifications.

Yet another object of this invention is to provide a particle removal means which processes hot products of combustion and removes therefrom both gross and miniscule particulate to produce a clean, high energy medium for immediate use.

Other objects and advantages of the present invention will become readily apparent from the following description and drawings.

DETAILED DESCRIPTION

The drawings show the present incinerating and processing system as it would be utilized in a lumber mill operation to produce clean heated gaseous medium for a wood drying kiln. The particular dimensions of the components of the invention to be described and their particular manner of operation are dependent upon the particular needs of each installation. That is, in a particular lumber mill a specified amount of energy, usually expressed in a number of Btu per hour, is required. The installation is designed accordingly to provide this amount of energy.

Figure 1:
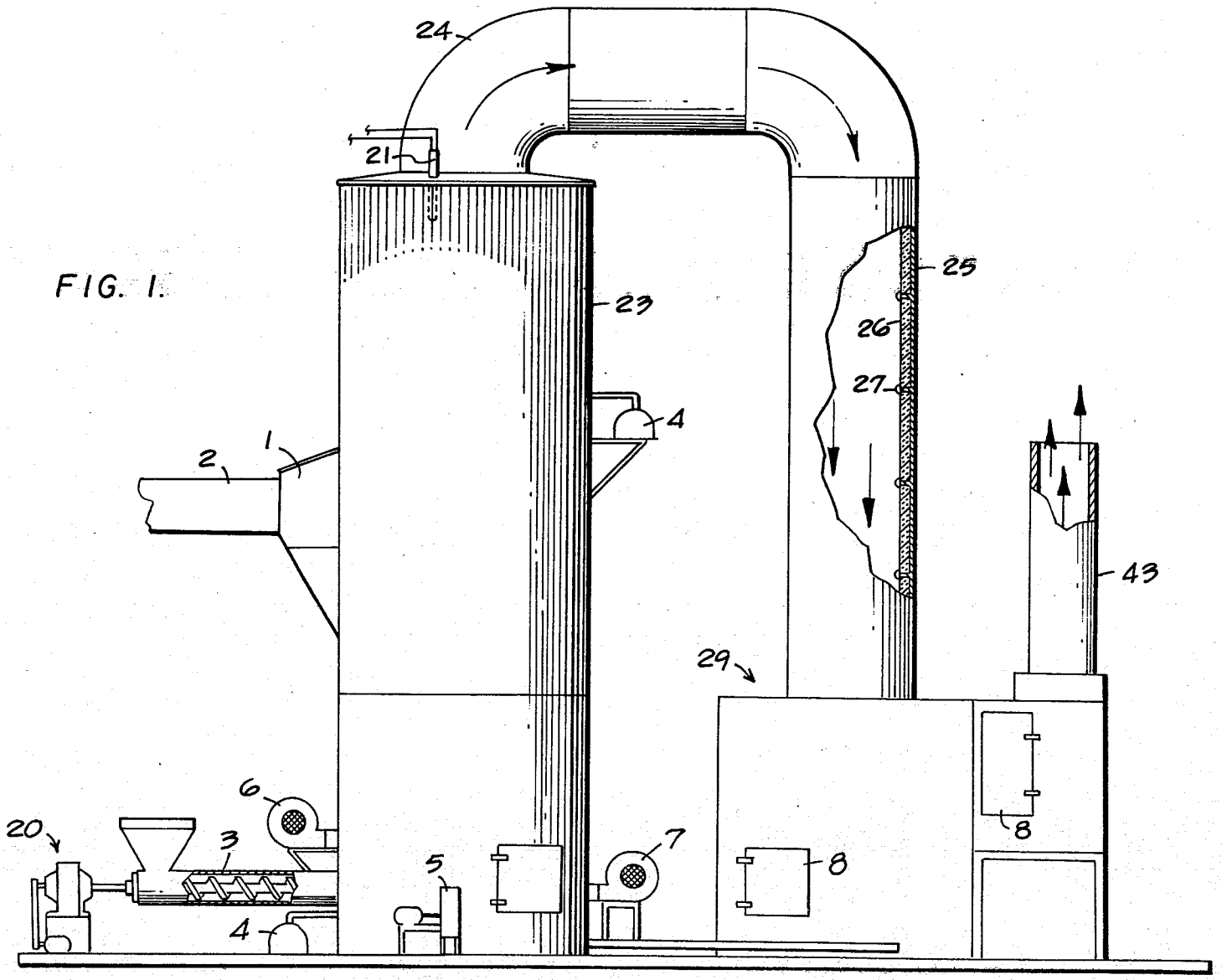
FIG. 1 is an overall schematic representation of the inventive system including the incinerator and the particle removal and retention means.
Figure 2:
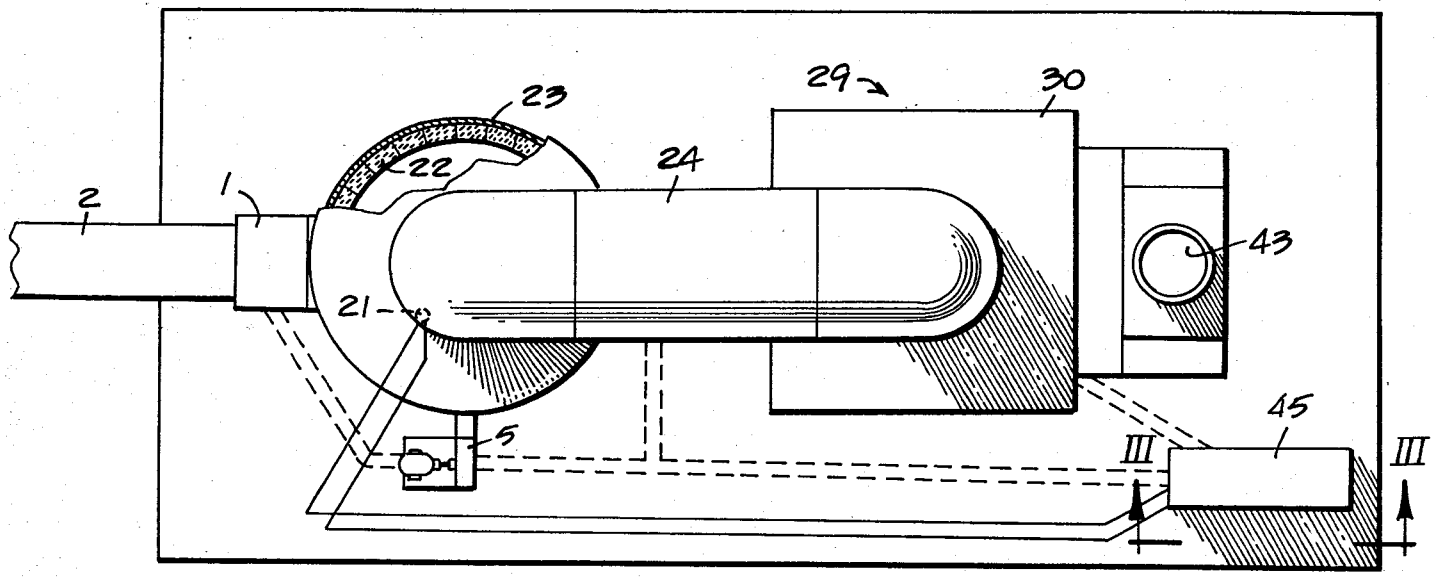
FIG. 2 is a plan view of the system shown in FIG. 1.

With reference to FIG. 1 of the drawings, a burner or incinerator is shown including an inlet chute 1 and conveyor means 2 for transmitting waste products from a lumber mill operation to the interior of the burner for combustion thereof. At 3 is shown an auger-type auxiliary fuel feeding means which is utilized either in addition to or in lieu of the conveyor 2 at such times as it is necessary to produce a closely regulated fuel supply rate for a given required amount of energy. Since within a given installation there might be a plurality of different energy requirements at various times due to seasonal conditions or the like, the auger 3 is driven by a variable speed motor and suitable gearing shown schematically at 20 so that the fuel feed rate may be closely controlled.

At 4 are shown a plurality of start-up burners disposed in various positions along the outer wall 23 of the incinerator. Such burners are preferably oil or gas fired and are individually thermostatically controlled to provide optimum results. The lowermost start-up burner is used to initiate the incineration process and will remain operative until the temperature of the combustion gasses, as measured by a probe 21 at the entrance to the outlet stack 24, reaches 750° F (339° C). The uppermost start-up burner will operate until the probe temperature reaches 1100° F (594° C). The purpose of such upper burner is to consume smoke or to "afterburn" the products of combustion and to increase the temperature thereof to at least 1100° F (594° C) so as to assure a relatively smokeless exhaust medium.

One of a plurality of blowers is shown at 5. This "under fire" blower becomes automatically operative when the probe control temperature reaches approximately 750° C (399° C) and continues to operate until system shut down. Additional "over fire" blowers 6 and 7 are disposed at varying heights along the incinerator wall. Such blowers become operative when the control temperature reaches 1100° F (594° C). The over fire blowers and their associated internally disposed tuyeres are located at different heights along the wall of the incinerator because the height of the waste fuel loading inside the incinerator is variable. In order for the incinerator to function properly, at least one of the over fire blowers must be permitted to produce tangentially emitted swirling air to the interior of the incinerator to enhance the natural cylclonic swirling effect therein and increase the burning retention time of any given volume of combustion products.

By way of further explanation, in the northern hemisphere of the globe, rising gaseous mediums have a tendency to rotate in a counterclockwise direction. This effect may be appreciated in a natural draft fire wherein the products of combustion are visible. As such combustion products rotate while rising, they tend to be exposed to the heat of the fire for a greater time then if they were to rise directly upwardly without swirling. This process produces more complete burning. In the instant system, this natural cyclonic effect is enhanced by the provision of the over fire blowers which increase the lateral travel time of the combustion medium and of the particles engrossed thereby and retain such particles proximate the heat source sufficiently long to accomplish substantially complete burning. As more air is introduced tangentially to the interior of the incinerator, the spiral wave length of the combustion medium is increased as is the completeness of the particulate burning.

As may be readily appreciated from an inspection of FIGS. and 2, the incinerator is cylindrically shaped. It is lined with suitable ceramic material 22 which retains heat energy and which protects the outer shell of the unit 23 from damage due to exposure to excessive heat.

The combustion medium produced within the incinerator is passed axially vertically from the unit via an outlet stack or conduit 24. The conduit is composed of mild steel gauge plates 25 which are lined interiorly with a glass blanket-type insulation material. Such material is commercially available in sheet form under the tradename KADWOOL from the Johns Manville Company of Toledo, Ohio or under the tradename LO-CON BLANKET from the Carborundum Corporation of Niagra Falls, New York. Such insulation material 26 is secured in place by means of studs 27 having ceramic buttons thereon. The interiormost surface of the insulation is coated with a ceramic hardener also available from the above-mentioned manufacturers. The hardener minimizes erosion of the insulation caused by particulate in the combustion medium.

Figure 4:
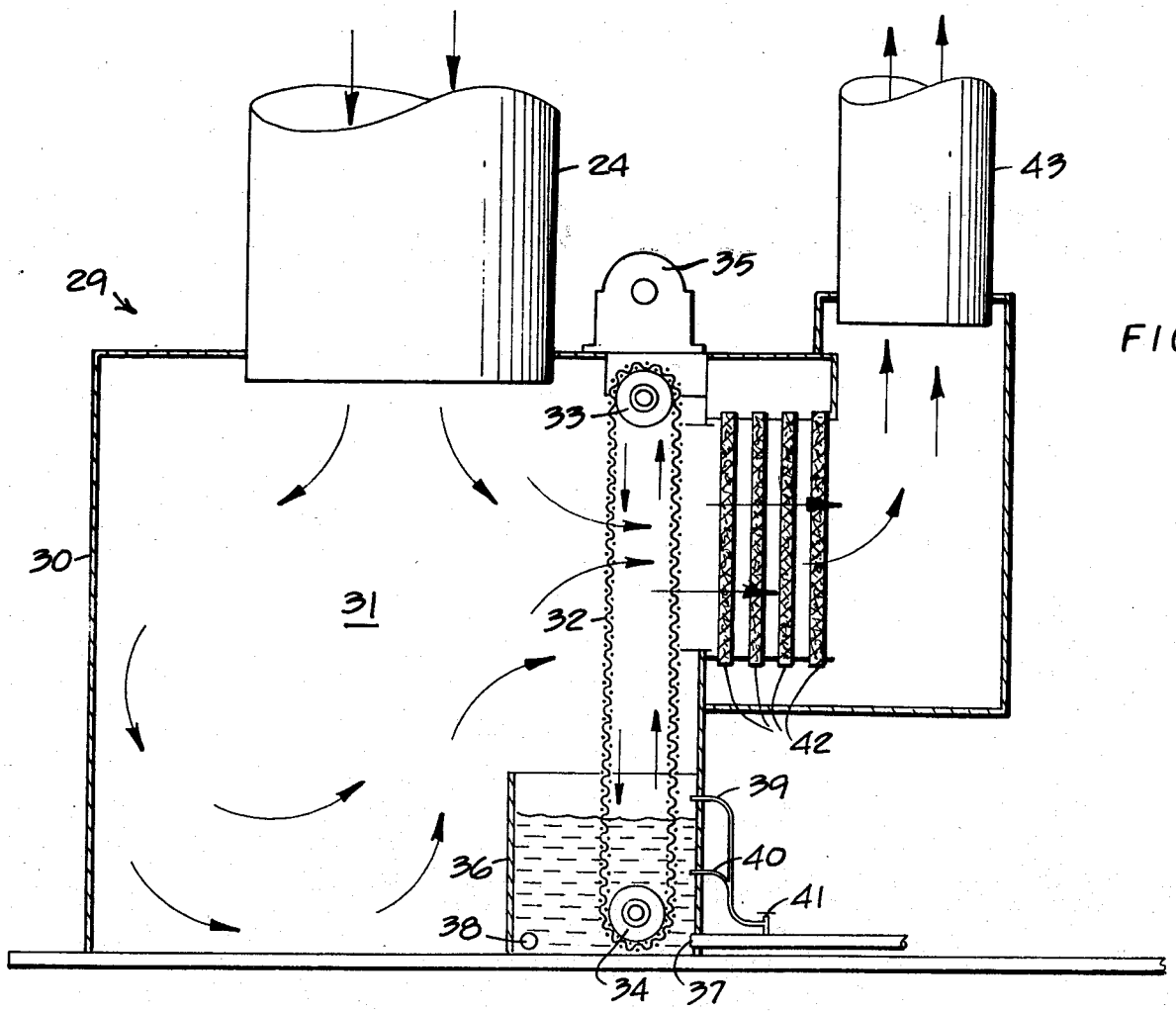
FIG. 4 is an enlarged partial view of the particle removal and retention arrangement of the instant invention.

The conduit structure 24 conveys combustion medium to a particle removal and retention arrangement shown generally at 29. The means 29, most clearly shown in FIG. 4, includes a housing structure 30 having suitable access means 8 and being comprised of steel plate insulated interiorly in the same manner as the conduit means 24 and also insulated exteriorly thereof for the protection of the steel material from ambient conditions and to improve heat retention. The casing defines an internal particle retention chamber 31 which is dimensioned suitably for any given particular set of conditions. In the preferred embodiment, the cross-sectional area of the particle retention chamber is approximately twice that of the conduit means 24. The removal and retention means include a revolving screen 32 suitably mounted for rotation about rollers 33, 34. The screen may be composed of commercially available steel material. A steel screen material having an approximately 1/16 inch mesh and being capable of withstanding, without appreciable distortion, temperatures in the vicinity of 2000° F (1093° C). Stainless steel (S.S. 310) would be an appropriate material. The revolving screen is driven by suitable motor means 35 which are capable of driving the screen at variable rates dependent upon given control parameters which will be described more fully hereinafter. Essentially, the revolution speed of the screen will depend upon the rate of combustion medium flow therethrough.

It may be noted that the lower roller 34 for the screen is immersed in a water bath tank 36. The purpose of the water bath is to cleanse from the revolving screen accumulated deposits of particles extracted from the combustion medium and to cool the screen. The water bath tank is equipped with suitable water inlet 37 and outlet 38 means. The outlet means 38 may be directed to a sewage collection point or may be recycled to the incinerator so that the particles entrapped in the water bath are burned completely in a closed system. The water bath is equipped with suitable high and low water level probes 39, 40 which, through suitable electrical control means, control the opening and closing of an inlet valve 41 for regulating the level in the tank.

It has been determined that combustion medium passing through the screen 32 will loose approximately 98.6% of its particulate content. Much of the additional content may be removed by means of filter bank 42. The filter elements of the bank may be commercially available items such as the "type absolute filter", manufactured by the Planters Corporaton of Pittsburgh, Pennsylvania, but such elements must comply with Mining Standards Association (MSA) specifications. Such filter elements should be capable of removing up to 99.7% of the remaining particulate of a size 0.3 micron or larger.

Figure 3:
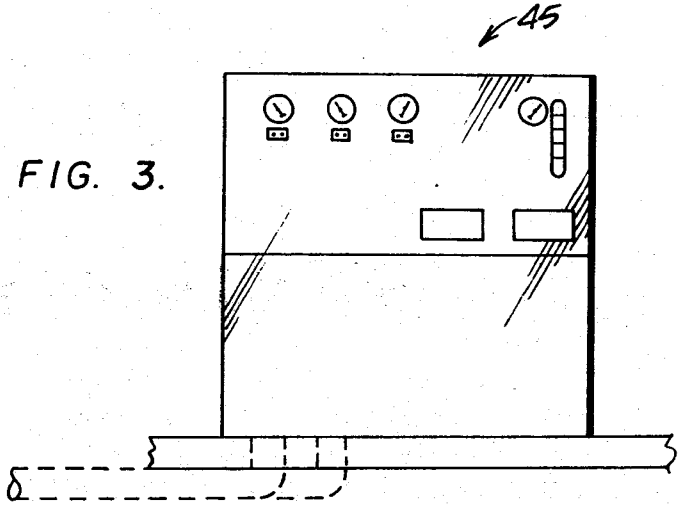
FIG. 3 is a schematic representation of the control means for the present invention.

It is anticipated that the entire system, from fuel supply inlet rate to exhaustion for utilization of the clean combustion medium at exhaust stack 43 be controlled automatically at a master control center shown schematically in FIG. 3. Essentially, the control center includes gauges showing the state of operability of each of the blowers and the burners, and includes a singular temperature readout corresponding to the temperature at probe 21. It is this temperature which is fed to the control system 45 for the automatic regulator of the aforementioned multiple functions of the incinerating and processing system. The control center 45 responds to the temperature as measured by probe 21 to program a sequential contacter which, in turn, opens and closes a plurality of auxiliary switches (not shown) for controlling the various drive motors of the system. Of course, the system could be designed to utilize, where desired, other parameters such as pressure, moisture content, and the like as control functions.

It may be seen that the present invention provides an efficient and relatively uncomplex system for utilizing waste products as a fuel to produce a substantially particulate free, temperature controlled clean combustion medium for direct utilization in heating or drying operations such as might be encountered in a lumber drying kiln. Although the invention has been described with reference to the particular preferred embodiments, it will be apparent to those skilled in the art that many variations and modifications are possible within the spirit of the inventive concepts. No limitation is intended with respect to such variations and modifications except as comprehended by the scope of the appended claims.

We claim:

1. An anti-pollution incinerating system comprising; incinerator means for consuming fuel by combustion, fuel supply means for controllably supplying fuel to said incinerator means, said incinerator means including incinerator outlet means for transmitting heated medium containing the products of said combustion of said fuel from said incinerator means, particle removal means for receiving said heated medium from said incinerator outlet means and for removing particulate therefrom, conduit means connected between said incinerator means and said particle removal means for communicating said medium from said incinerator means to said particle removal means, said particle removal means including medium exhaust means for transmitting clean heated medium from said particle removal means after removal of said particulate from said medium, said incinerator means including a burner vessel having metallic wall means lined with heat energy retaining material means, said incinerator means further including burner means for initiating said combustion and for affecting the temperature of said combustion of said fuel, said incinerator means further including blower means for supplying combustion supporting fluid to the interior of said vessel, said blower means including a plurality of spaced-apart individually operable blower devices each having an outlet portion disposed interiorly of said vessel, each said outlet portion including a tuyere and said tuyeres being tangentially arranged in said vessel to produce a swirling or cyclonic flow pattern in said combustion on supporting fluid, and further including master control means for concurrently controlling the operation of said fuel supply means, said blower means, said burner means, and said particle removal means.

2. An anti-pollution incinerating system comprising; incinerator means for consuming fuel by combustion, fuel supply means for controllably supplying fuel to said incinerator means, said incinerator means including incinerator outlet means for transmitting heated medium containing the products of said combustion of said fuel from said incinerator means, particle removal means for receiving said heated medium from said incinerator outlet means and for removing particulate therefrom, conduit means connected between said incinerator means and said particle removal means for communicating said medium from said incinerator means to said particle removal means, said particle removal means including medium exhaust means for transmitting clean heated medium from said particle removal means after removal of said particulate from said medium, said incinerator means including blower means for supplying combustion supporting fluid, said incinerator means further including burner means for initiating said combustion, and master control means for concurrently controlling the operation of said fuel supply means, said blower means, said burner means, and said particle removal means.

3. The invention of claim 2 wherein said incinerator means include a burner vessel having metallic wall means lined with heat energy retaining material means.

4. The invention of claim 3 wherein said fuel supply means include conveying means for automatically conveying fuel to an interior portion of said burner vessel.

5. The invention of claim 4 wherein said conveying means include auger means.

6. The invention of claim 5 wherein said conveying means further include an additional conveyor device spaced-apart from said auger means along said wall means.

7. The invention of claim 3 wherein said incinerator means further include burner means for initiating said combustion and for affecting the temperature of said combustion of said fuel.

8. The invention of claim 7 wherein said incinerator means further includes blower means for supplying combustion supporting fluid to the interior of said vessel.

9. The invention of claim 8 wherein said burner means include a plurality of individually operable burner devices disposed along said vessel wall in spaced-apart relationship.

10. The invention of claim 8 wherein said blower means includes a plurality of spaced-apart individually operable blower devices each having an outlet portion disposed interiorly of said vessel.

11. The invention of claim 10 wherein each said outlet portion includes a tuyere and wherein said tuyeres are tangentially arranged in said vessel to produce a swirling or cyclonic flow pattern in said combustion supporting fluid.

12. The invention of claim 2 wherein said master control means include heat sensing means disposed within said incinerator outlet means for sensing the temperature of heated medium, the operation of said fuel supply means, said blower means, and said burner means being responsive to signals from said sensing means.

13. The invention of claim 2 wherein said particle removal means include a housing and a moving screen means in said housing between said conduit means and said medium exhaust means for entrapping and removing gross particulate from said medium.

14. The invention of claim 13 wherein said moving screen means include a flexible metallic screen mounted upon roller means for continuous movement across the path of said medium, said particle removal means further including automatic cleaning means for continuously removing particulate trapped by said flexible screen from said screen.

15. The invention of claim 14 wherein said cleaning means include water bath means including water inlet and outlet means and water level control means for sensing and controlling the level of water in said water bath means.

16. The invention of claim 14 wherein said particle removal means further include filter element means disposed within said housing in the path of said medium for entrapping miniscule particulate from said medium.

17. The invention of claim 16, said housing having access opening means for providing ready access to the interior of said housing for servicing of said filter element means and said screen cleaning means.

18. The invention of claim 3 wherein said vessel lining is fabricated from ceramic material and wherein said conduit means is at least partially lined with heat insulating material.

* * * * *